US010240493B2

(12) United States Patent
Nance et al.

(10) Patent No.: US 10,240,493 B2
(45) Date of Patent: Mar. 26, 2019

(54) CAM PHASER

(71) Applicant: ECO Holidng 1 GmbH, Marktheidenfeld (DE)

(72) Inventors: Steve Nance, Highland Village, TX (US); John Snyder, Irving, TX (US)

(73) Assignee: ECO Holding 1 GmbH, Marktheidenfeld (DE)

( * ) Notice: Subject to any disclaimer, the term of this patent is extended or adjusted under 35 U.S.C. 154(b) by 81 days.

(21) Appl. No.: 15/406,922

(22) Filed: Jan. 16, 2017

(65) Prior Publication Data

US 2017/0260884 A1 Sep. 14, 2017

Related U.S. Application Data

(60) Provisional application No. 62/307,753, filed on Mar. 14, 2016.

(51) Int. Cl.
*F01L 1/46* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 1/46* (2013.01); *F01L 2001/3445* (2013.01); *F01L 2001/34433* (2013.01); *F01L 2001/34469* (2013.01); *F01L 2001/34483* (2013.01); *F01L 2103/00* (2013.01); *F01L 2250/02* (2013.01); *F01L 2820/031* (2013.01)

(58) Field of Classification Search
CPC ..... F01L 1/047; F01L 2001/3443; F01L 2001/34433; F01L 2001/3445; F01L 1/46
USPC ..... 123/90.15, 90.17
See application file for complete search history.

(56) References Cited

U.S. PATENT DOCUMENTS

2013/0269638 A1 10/2013 Adachi et al.
2016/0076409 A1* 3/2016 Nagura ..... F01L 1/34 123/90.15
2017/0138225 A1* 5/2017 Hamasaki ..... F01L 1/3442
2017/0183987 A1* 6/2017 Noguchi ..... F01L 1/356
2018/0135469 A1* 5/2018 Manako ..... F01L 1/047

FOREIGN PATENT DOCUMENTS

DE 102006057492 A1 5/2010
DE 102010018202 A1 10/2011
JP WO 2015122359 A1 * 8/2015 ..... F01L 1/3442
WO WO2015122359 A1 8/2015

* cited by examiner

*Primary Examiner* — Jorge Leon, Jr.
(74) *Attorney, Agent, or Firm* — Friedrich von Rohrscheidt

(57) ABSTRACT

A cam phaser including a rotation phaser and a hydraulic valve hydraulically loading the rotation phaser, wherein the hydraulic valve is connectable torque proof with a cam shaft so that the cam shaft is rotatable, wherein the rotation phaser includes a stator and a rotor configured coaxial with the stator, wherein the rotor is rotatable relative to the stator, wherein the hydraulic valve is configured so that it protrudes at least partially into the rotation phaser, wherein an adapter is provided for a relative axial positioning of the rotor and the stator. According to the invention the adapter is configured for loose mounting in the rotation phaser so that a fixated connection of the adapter in the rotation phaser is provided when the cam shaft is mounted at the hydraulic valve.

16 Claims, 3 Drawing Sheets

CAM PHASER

RELATED APPLICATIONS

This application claims priority from and incorporates by reference U.S. Provisional Patent Application 62/307,753 filed on Mar. 14, 2016.

FIELD OF THE INVENTION

The invention relates to a cam phaser according to the preamble of patent claim 1.

BACKGROUND OF THE INVENTION

Cam phasers for internal combustion engines are well known. The cam phaser includes a hydraulic valve which is connected torque proof with the cam shaft and which is provided for hydraulically loading a rotation phaser of the cam phaser. The cam phaser is indirectly connected with a crank shaft of the internal combustion engine so that an angular position of the crank shaft relative to the cam shaft is variable by loading the rotation phaser.

A cam phaser can be derived from the publication document DE 10 2010 018 202 A1 wherein the cam phaser includes a cam shaft adapter for axially connecting the cam phaser with a cam shaft. The cam shaft adapter is connected with the cam shaft in a form locking manner and clamped to a rotor of the cam phaser. This causes a high level of fabrication complexity and thus cost since the cam shaft adapter has to be configured to provide a clamping connection and a form locking connection.

It is further known to bond the cam shaft adapter with the rotor. It is also known to configure the adapter integrally in one piece together with the rotor.

BRIEF SUMMARY OF THE INVENTION

Thus, it is an object of the invention to provide a cam phaser which operates reliably and which can be produced in a cost effective manner.

The object is achieved according to the invention by a cam phaser including a rotation phaser; and a hydraulic valve hydraulically loading the rotation phaser, wherein the hydraulic valve is connectable torque proof with a cam shaft so that the cam shaft is rotatable relative to the rotation phaser, wherein the rotation phaser includes a stator and a rotor configured coaxial with the stator, wherein the rotor is rotatable relative to the stator, wherein the hydraulic valve is configured so that it protrudes at least partially into the rotation phaser, wherein an adapter provides relative axial positioning of the rotor and the stator, and wherein the adapter is configured for loose mounting in the rotation phaser so that a fixated connection of the adapter in the rotation phaser is provided when the cam shaft is mounted at the hydraulic valve.

Advantageous embodiments with useful and non-trivial variations of the invention are provided in the respective dependent claims.

The cam phaser according to the invention includes a rotation phaser and a hydraulic valve that loads the rotation phaser hydraulically. The hydraulic valve is connectable torque proof with a cam shaft in order to rotate the cam shaft. The rotation phaser includes a stator and a rotor that is provided coaxial with the stator, wherein the rotor is rotatable relative to the stator. The hydraulic valve is configured so that it protrudes into the rotation phaser at least partially.

An adapter is provided for a relative axial positioning of the rotor and the stator. According to the invention the adapter is configured for a loose assembly in the rotation phaser and a firm connection of the adapter with the rotation phaser is provided after mounting the cam shaft onto the hydraulic valve.

This means that the adapter is only fixated and sealed in position on the cam shaft in the rotation phaser after the cam phaser is mounted. The loose adapter does not require a press connection or a bonded connection, e.g. gluing for connecting with the rotor. By reducing a number of assembly steps the assembly is more cost effective than provided in the prior art.

Reducing a number of fabrication steps of the adapter is another advantage since an outer diameter of the adapter does not have to be configured precisely. Fabricating the outer diameter is typically performed using a turning operation. This fabrication step is typically required in particular when press fitting the adapter or when gluing the adapter together with the rotor so that an adapter can be provided that is precisely configured for fabricating the respective connection.

Another advantage of the loose connection with the rotation phaser is a relatively free engineering design of the cam phaser. Thus, the cam phaser can be associated with different cam shafts by replacing the adapter. Thus, an essential development and assembly step for providing a cam phaser for a cam shaft is eliminated.

It is another advantage that the rotor can be fabricated in a simple configuration and thus in a cost effective manner since it can be configured as two e.g. circular flat discs.

In one embodiment of the cam phaser according to the invention a radial clearance is configured between the adapter and the rotor, which is maintained at all times. An over constraint at an outside of the adapter may be excluded because of this.

In one embodiment of the cam phaser according to the invention the hydraulic valve is configured as a central valve with an external thread. This has the advantage that the central valve with the external thread provides centering for the rotor, the stator and the adapter. The components of the cam phaser can be clamped by the externally threaded central valve in an axial sequence and the adapter facilitates relative axial positioning of the rotor and the stator. Furthermore a tight seal between the rotor and the adapter is provided by tightening the externally threaded central valve.

It is an advantage of arranging the adapter between the cam shaft and the rotor that the adapter can adjust the necessary axial position in a simple manner by positioning the cam shaft when connecting the camshaft with the hydraulic valve.

In another embodiment of the cam phaser according to the invention a straight bearing is configured between the cam phaser and the adapter, wherein the radial clearance is provided between the radial straight bearing and the adapter. Bearing surfaces are provided between the bearing and the rotor respectively the drive wheel only. In particular the straight bearing is configured as a radial straight bearing configured as a floating radial bearing.

In case the adapter has an annular shoulder at an end oriented towards the rotor a fixation of the adapter during an assembly on a camshaft is provided.

In another embodiment the adapter includes at least one circumferential recess penetrating the adapter in a radial direction. Thus, for example a tank connection of the hydraulic valve can be provided for draining through the adapter. In order to provide a simple and cost effective embodiment the recess is groove shaped.

BRIEF DESCRIPTION OF THE DRAWINGS

Other advantages, features and detail of the invention can be derived from the subsequent description of advantageous embodiment and from the drawing figures. The features and feature combinations recited in the preceding description and the features and feature combinations recited and shown individually in the figure description and the figures are not only useable in the respectively recited combination but also in other combinations or by themselves without departing from the spirit and scope of the invention. Identical or functionally equivalent elements are designated with identical reference numerals. For reasons of clarity it is possible that elements are not only designated with reference numerals in all figures without losing their association, wherein.

DETAILED DESCRIPTION OF THE INVENTION

Figure 1:
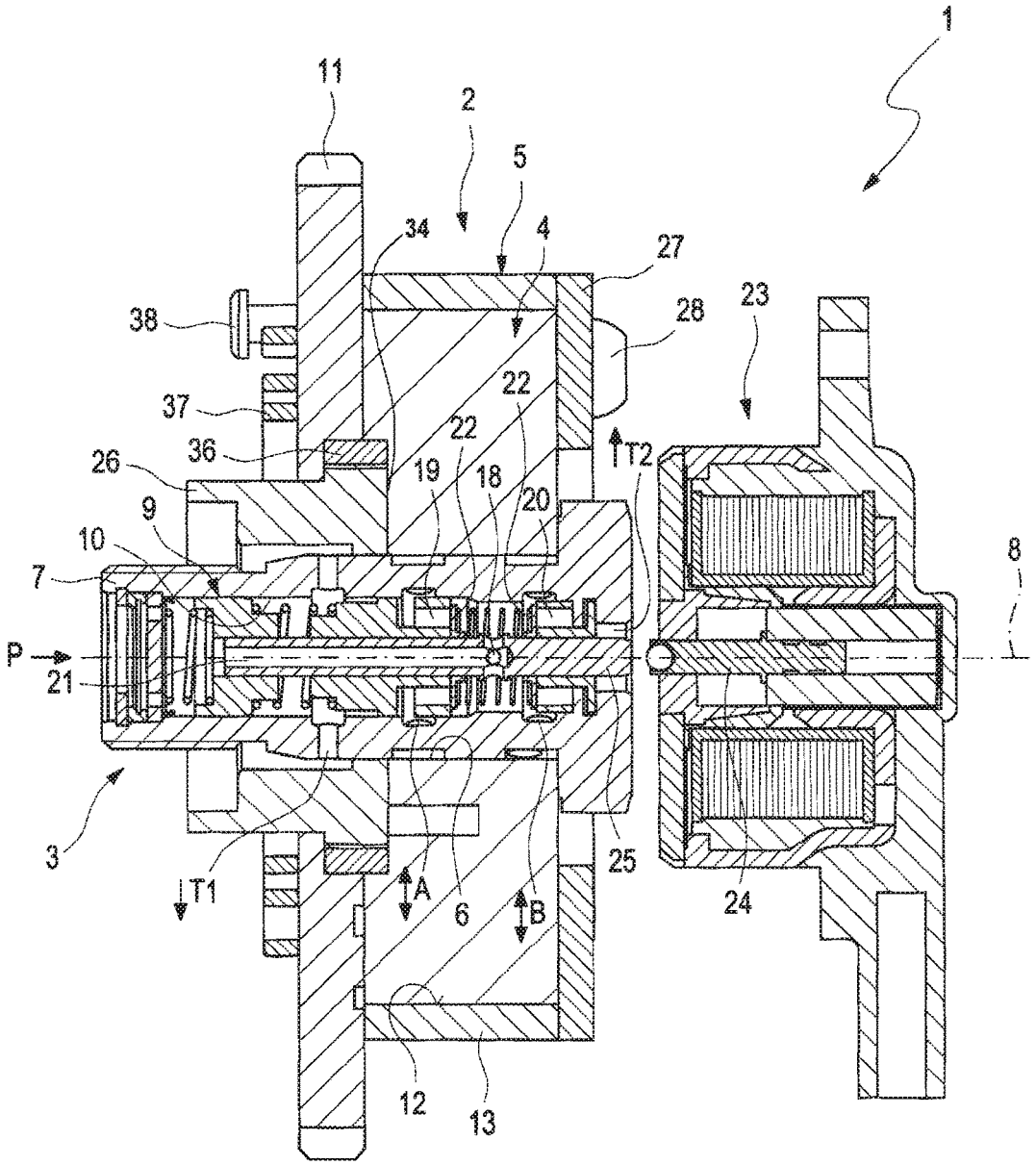
FIG. 1 illustrates a longitudinal sectional view of cam phaser according to the invention.

A cam phaser 1 for an internal combustion engine that is not illustrated in more detail to adjust engine timing, put differently opening and closing times of gas control valves of the internal combustion engine is configured in a first embodiment according to FIG. 1. The cam phaser 1 facilitates adjusting engine timing during operation of the internal combustion engine. Thus, the cam phaser 1 continuously adjusts a relative angular position of a cam shaft of the internal combustion engine that is not illustrated in more detail relative to a crank shaft of the internal combustion engine that is not illustrated in more detail, wherein the cam shaft is rotated relative to the crank shaft. Rotating the cam shaft moves the opening and closing times of the gas control valves so that the internal combustion engine can deliver optimum power at a given speed.

The cam phaser 1 includes a rotation phaser 2 and a hydraulic valve 3. The rotation phaser 2 essentially includes a rotor 4 and a stator 5 enveloping the rotor 4. In order to receive the rotor 4 the hydraulic valve 3 is configured as an externally threaded central valve which can also be designated as central bolt. This means put differently the hydraulic valve 3 is received in a central phaser opening 6 of the rotation phaser 2 so that the hydraulic valve 3 is at least partially enveloped by the rotation phaser.

The hydraulic valve 3 includes a housing 7 which is configured flowable. In order to hydraulically supply the rotation phaser 2 plural connections A, B, P, T1, T2 are provided at the housing 7. In the housing 7 a piston 9 is received in a central opening 10 of the housing 7 wherein the piston is axially movable along a first longitudinal axis 8 of the hydraulic valve 3. The housing 7 is configured substantially tubular.

The stator 5 of the rotation phaser 2 is connected torque proof with a drive wheel 11 of the cam shaft. At insides 12 of a stator base element 13 radially inward protruding bars 14 are configured with uniform spacing so that an intermediary space 15 is formed between two respectively adjacent bars 14. A lobe 16 of a rotor hub 17 of the rotor 4 is arranged so that it protrudes into the intermediary space 15. The rotor hub 17 includes a plurality of lobes 16 corresponding to a plurality of intermediary spaces 15. Thus, each intermediary space 15 is divided into two pressure cavities by the lobes 16. A pressure medium, typically a hydraulic fluid is introduced into the pressure cavities in a controlled manner by the hydraulic valve 3.

A pressure cavity is associated with each operating connection A, B. In order to adjust an angular position between the cam shaft and the crank shaft the pressure medium in a first pressure cavity or a in a second pressure cavity is pressurized while the second pressure cavity or the first pressure cavity is unloaded. The unloading is performed through the first tank connection T1 or the second tank connection T2 so that the hydraulic fluid can drain through the tank connections T1, T2.

The piston 9 is configured cylindrical and includes flow through openings, a first flow through opening 18 and second flow through opening 19 and a third flow through opening 20. Each flow through opening 18, 19, 20 is configured completely flowable starting from a central channel 21 of the piston 9 so that the hydraulic fluid can flow through the central channel 21 through the flow through openings 18, 19, 20 into the operating connections A, B and tank connection T1, T2. In order to prevent a back flow of the hydraulic fluid into the central channel 21 when the pressure cavities are emptied the flow through openings 19, 20 associated with the operating connections A, B have check valves 22.

The piston 9, is positioned by an electromagnetic actuator 23 so that a corresponding loading of the pressure cavities can be performed. An actuation plunger 24 is configured so that it engages a piston plunger 25 including the central channel 21 so that the piston 9 is positioned in the central opening 10 using the actuator 23.

In order to provide an axial fixation and for an axial positioning of the rotor 4 and the stator 5 an adapter 26 is configured so that it radially envelops the housing 7 at least partially. The adapter 26 is axially and radially moveable before the cam shaft is attached at the housing 7. There is a close tolerance fit between the housing 7 and the adapter 26 after the valve 3 is installed.

Figure 2:
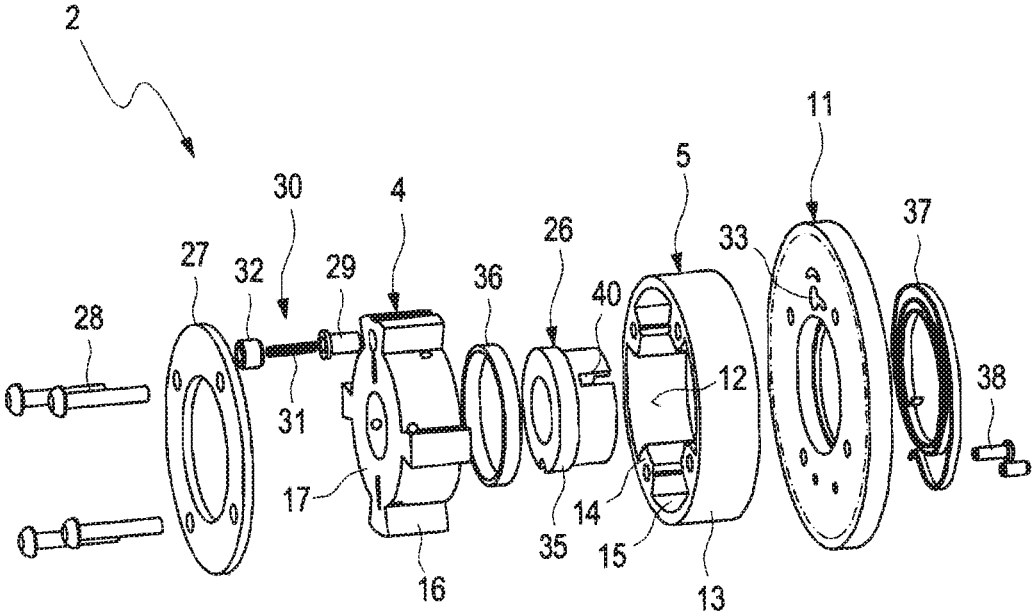
FIG. 2 illustrates an exploded view of a rotation phaser of the cam phaser according to FIG. 1.

FIG. 2 illustrates the rotation phaser 2 of the cam phaser 1 according to the invention in an exploded view. In addition to the rotor 4 and the stator 5 the rotation phaser 2 includes a safety disc 27 which is configured to axially secure the rotor 4. The safety disc 27 is connected torque proof with the stator 5 using the attachment devices 28. Furthermore the safety disc 27 is used for receiving a locking pin 29 of a locking device 30 of the rotation phaser 2, wherein the locking device 30 furthermore includes a reset element 31 configured as a spiral spring and a cover element 32 which is configured for hydraulically loading the locking device 30. In order to lock the rotor 4 together with the stator 5 the locking pin 29 is positioned in a receiving opening 33 of the drive wheel 11.

The adapter 26 is configured cylindrical and includes an annular shoulder 35 at and end 34 oriented towards the rotor 4, wherein the shoulder 35 is used as an axial stop for the rotor 4 and the drive wheel 11 and holds the adapter 26 in place during an assembly on a camshaft.

The straight bearing 36 is configured in particular as a floating straight bearing 36 for providing a radial support. The straight bearing 36 supports the rotor 4 and the drive wheel 11, so that bearing surfaces are provided between the bearing 36 and the rotor respectively the drive wheel 11 only. As can be seen from FIG. 1 there is a clearance between the bearing 36 and the adapter 26. Thus, both components, the rotor 4 and the drive wheel 11 are supported by a single straight bearing 36 in a cost effective manner. An over constraint at an outside of the adapter 26 may be excluded because of the radial clearance between the adapter 26 and the bearing 36.

The adapter 26 has a groove shaped recess 40 at its circumference. The groove shaped recess 40 can be used for draining the hydraulic fluid through the first tank connection T1.

The drive wheel 11 includes a positioning element 37 which is configured as a spiral spring. The positioning element 37 is secured at the drive wheel 11 by a pin 38. The drive wheel 11 is connected torque proof with the stator 5 by the attachment devices 28. The rotor 4 is urged into a circumferential direction by the positioning element 37.

Figure 3:
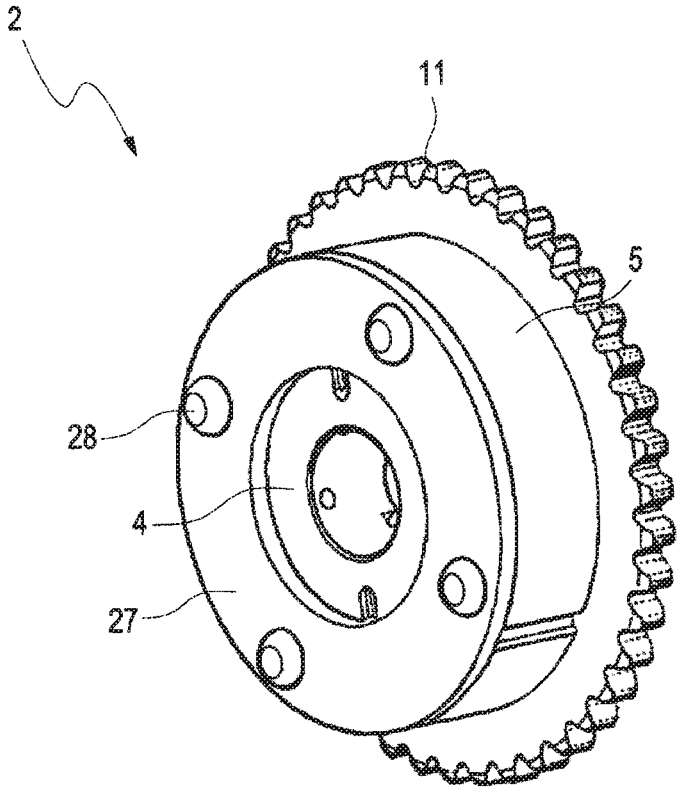
FIG. 3 illustrates a perspective view of the rotation phaser according to FIG. 2.

FIG. 3 illustrates the rotation phaser 2 in a perspective view in assembled condition.

Figure 4:
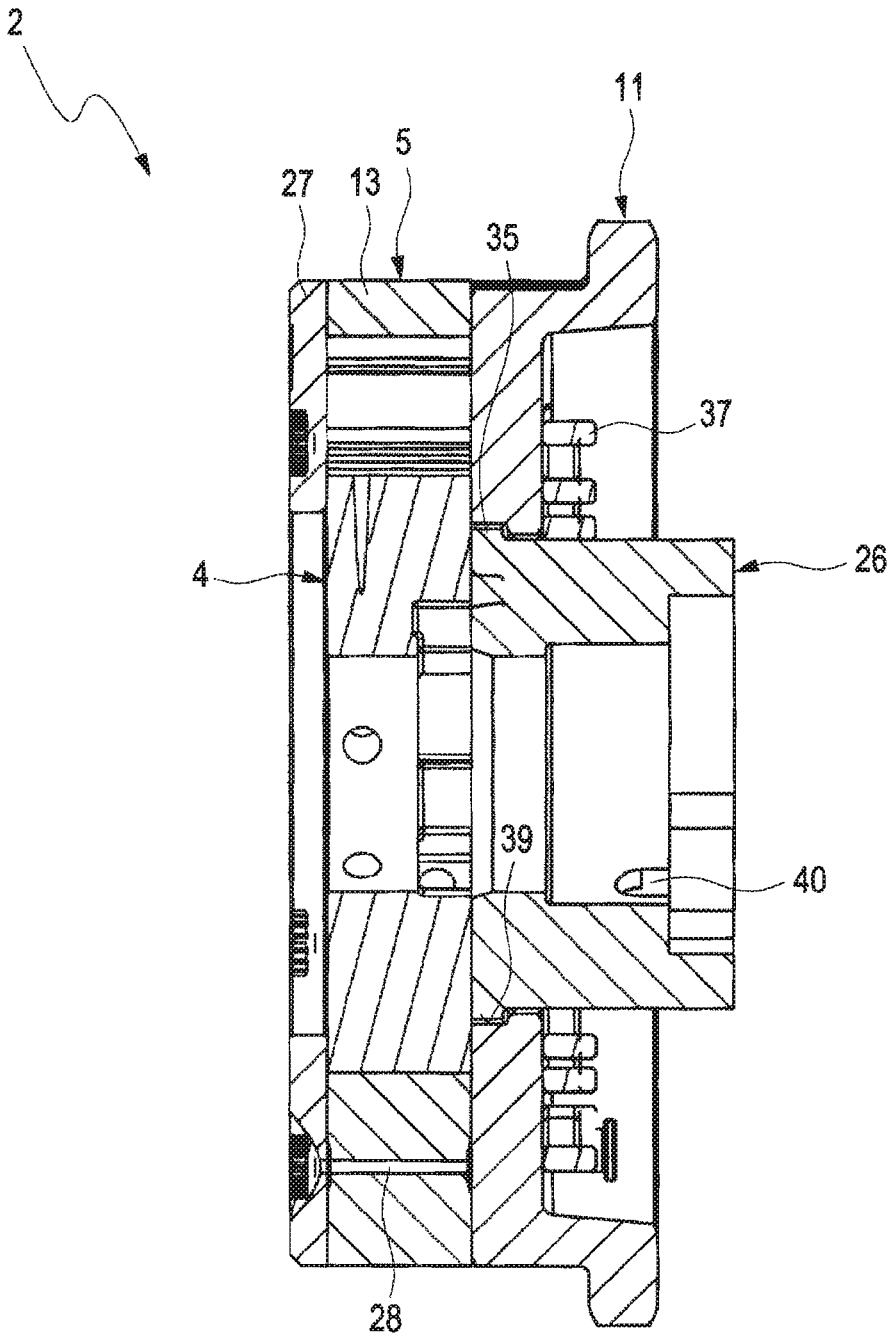
FIG. 4 illustrates a longitudinal sectional view with an adapter in a second embodiment of the cam phaser according to the invention.

FIG. 4 illustrates the rotation phaser 2 of the cam phaser 1 in a second embodiment. Between an inner surface 39 oriented towards the adapter 26 and the adapter 26 a clearance is maintained at all times. Bearing surfaces are provided between the rotor 4 and the stator 5 only. A separate annular sliding bearing can be omitted. This reduces assembly complexity and cost can be additionally reduced by omitting the sliding bearing. An over constraint at an outside of the adapter 26 may be excluded because of the radial clearance between the adapter 26 and the drive wheel 11.

REFERENCE NUMERALS AND DESIGNATIONS

1 cam phaser
2 rotation phaser
3 hydraulic valve
4 rotor
5 stator
6 phaser opening
7 housing
8 first longitudinal axis
9 piston
10 central opening
11 drive wheel
12 inner side
13 stator base element
14 bar
15 intermediary space
16 lobe
17 rotor hub
18 first flow through opening
19 second flow through opening
20 third flow through opening
21 central channel
22 check valve
23 actuator
24 actuator plunger
25 piston plunger
26 adapter
27 safety disc
28 attachment device
29 locking pin
30 locking device
31 reset element
32 cover element
33 receiving opening
34 end
35 annular shoulder
36 straight bearing
37 positioning element
38 pin
39 inner surface
40 recess
A first operating connection
B second operating connection
P supply connection
T1 first tank connection
T2 second tank connection

What is claimed is:

1. A cam phaser, comprising:
a rotation phaser; and
a hydraulic valve hydraulically loading the rotation phaser,
wherein the hydraulic valve is connectable torque proof with a cam shaft so that the cam shaft is rotatable relative to the rotation phaser,
wherein the rotation phaser includes a stator and a rotor configured coaxial with the stator,
wherein the rotor is rotatable relative to the stator,
wherein the hydraulic valve protrudes at least partially into the rotation phaser,
wherein an adapter provides relative axial positioning of the rotor and the stator,
wherein the adapter is loosely mountable in the rotation phaser so that a fixated connection of the adapter in the rotation phaser is provided when the cam shaft is mounted at the hydraulic valve,
wherein a radial straight bearing is provided between the rotation phaser and the adapter, and
wherein a radial clearance is provided between the radial straight bearing and the adapter.

2. The cam phaser according to claim 1, wherein a radial clearance is provided between the adapter and the rotor.

3. The cam phaser according to claim 1, wherein the hydraulic valve is configured as an externally threaded central valve.

4. The adapter according to claim 1, wherein the adapter is arranged between the cam shaft and the rotor.

5. The cam phaser according to claim 1, wherein the straight bearing is configured as a floating radial bearing.

6. The cam phaser according to claim 1, wherein the adapter includes an annular shoulder at an end oriented towards the rotor.

7. The cam phaser according to claim 1, wherein the adapter includes at least one recess completely penetrating the adapter in a radial direction over a circumference of the adapter.

8. The cam phaser according to claim 7, wherein the recess is configured as a groove.

9. A cam phaser, comprising:
a rotation phaser; and
a hydraulic valve hydraulically loading the rotation phaser,
wherein the hydraulic valve is connectable torque proof with a cam shaft so that the cam shaft is rotatable relative to the rotation phaser,
wherein the rotation phaser includes a stator and a rotor configured coaxial with the stator,
wherein the rotor is rotatable relative to the stator,
wherein the hydraulic valve protrudes at least partially into the rotation phaser,
wherein an adapter provides relative axial positioning of the rotor and the stator, wherein the adapter is loosely mountable in the rotation phaser so that a fixated connection of the adapter in the rotation phaser is provided when the cam shaft is mounted at the hydraulic valve, wherein the rotor and a drive wheel are arranged in a radial direction on an annular shoulder of the adapter, and wherein a radial clearance is provided between the annular shoulder and the drive wheel.

10. The cam phaser according to claim 9, wherein a radial clearance is provided between the adapter and the rotor.

11. The cam phaser according to claim 9, wherein the hydraulic valve is configured as an externally threaded central valve.

12. The adapter according to claim 9, wherein the adapter is arranged between the cam shaft and the rotor.

13. The cam phaser according to claim 9, wherein a radial straight bearing is provided between the rotation phaser and the adapter, and wherein a radial clearance is provided between the radial straight bearing and the adapter.

14. The cam phaser according to claim 9, wherein the adapter includes an annular shoulder at an end oriented towards the rotor.

15. The cam phaser according to claim 9, wherein the adapter includes at least one recess completely penetrating the adapter in a radial direction over a circumference of the adapter.

16. The cam phaser according to claim 15, wherein the recess is configured as a groove.

* * * * *